US006429764B1

(12) United States Patent
Karam et al.

(10) Patent No.: US 6,429,764 B1
(45) Date of Patent: Aug. 6, 2002

(54) MICROCOMPONENTS OF THE MICROINDUCTOR OR MICROTRANSFORMER TYPE AND PROCESS FOR FABRICATING SUCH MICROCOMPONENTS

(75) Inventors: Jean-Michel Karam; Laurent Basteres; Ahmed Mhani, all of Grenoble; Catherine Charrier, Saint Martin; Eric Bouchon, Saint Egreve; Guy Imbert, Grenoble; Patrick Martin; François Valentin, both of Veurey Voroize, all of (FR)

(73) Assignee: Memscap & Planhead-Silmag PHS (FR)

( * ) Notice: Subject to any disclaimer, the term of this patent is extended or adjusted under 35 U.S.C. 154(b) by 0 days.

(21) Appl. No.: 09/558,641

(22) Filed: Apr. 26, 2000

(30) Foreign Application Priority Data

May 18, 1999 (FR) ..... 99 06433

(51) Int. Cl.[7] ..... H01F 5/00

(52) U.S. Cl. ..... 336/200; 336/223; 336/232; 29/602.1

(58) Field of Search ..... 336/200, 223, 336/232; 29/602.1, 606, 605

(56) References Cited

U.S. PATENT DOCUMENTS 3,305,814 A * 2/1967 Moyer ..... 336/200
4,933,209 A * 6/1990 Anthony et al. ..... 427/116
5,336,921 A * 8/1994 Sundaram et al. ..... 257/531
5,884,990 A 3/1999 Burghartz et al. ..... 336/200
5,898,991 A * 5/1999 Fogel et al. ..... 29/602.1

FOREIGN PATENT DOCUMENTS

EP 0 727 771 A2 8/1996
JP 08-203760 A * 8/1996

OTHER PUBLICATIONS

Article entitled Microcoils fabricated by UV depth lithography and galvanoplating by B. Lochel, a. Maciossek, M. Rothe, W. Windbracke from publication entitled"Sensors and Actuators" A 54 (1996) pp. 663–668.

* cited by examiner

*Primary Examiner*—Anh Mai
(74) *Attorney, Agent, or Firm*—Wall Marjama & Bilinski LLP

(57) ABSTRACT

Apparatus and Method relating to a microcomponent such as an inductor in which copper segments are mounted in parallel channels of a non-conductive substrate so that the top surfaces of the segments are coplanar with the top surface of the substrate. A core material is placed over the top surface of the substrate and conductive arches are arranged to connect one end of each segment with the opposite end of an adjacent segment to form a coil that encircles the core.

11 Claims, 5 Drawing Sheets

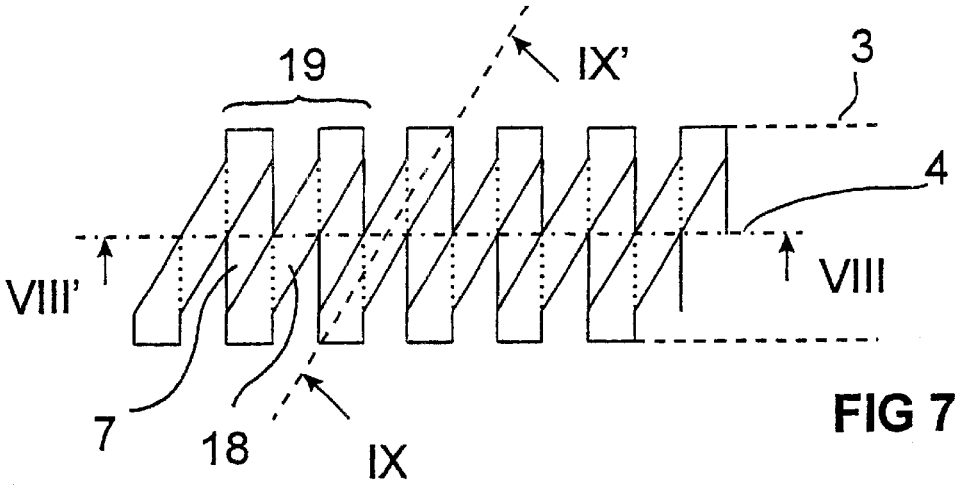
FIG 7
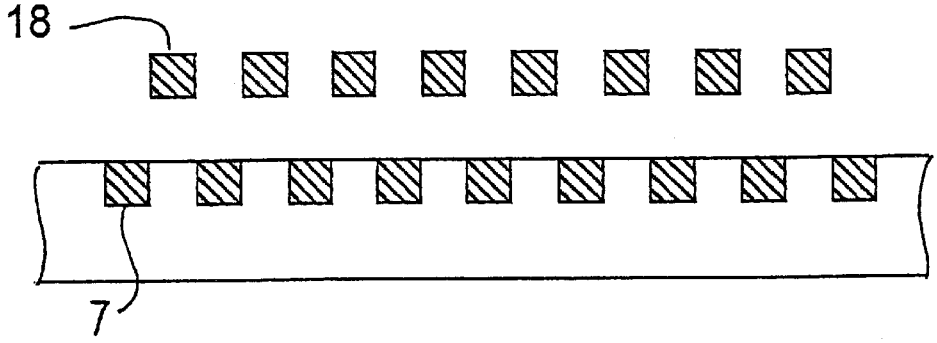
FIG 8
FIG 9
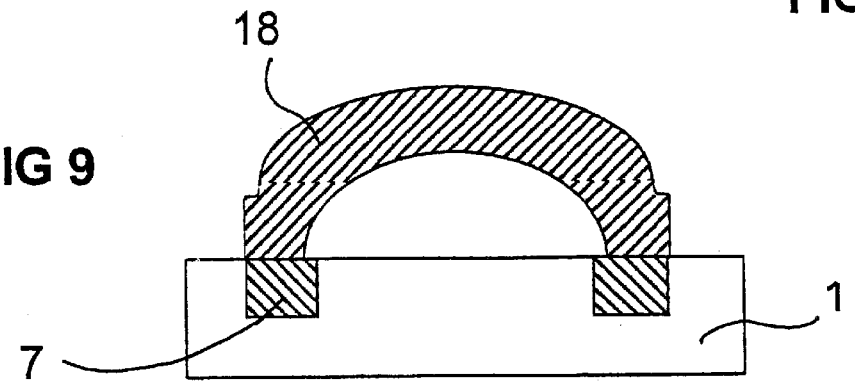

MICROCOMPONENTS OF THE MICROINDUCTOR OR MICROTRANSFORMER TYPE AND PROCESS FOR FABRICATING SUCH MICROCOMPONENTS

FIELD OF THE INVENTION

The invention relates to the field of microelectronics, and more specifically to the sector of the fabrication of microcomponents, especially those intended to be used in radiofrequency applications. It relates more particularly to microcomponents such as microinductors or microtransformers. It also relates to a process for fabricating such microcomponents, making it possible to obtain components having a high inductance and minimal resistive and magnetic losses.

PRIOR ART

As is well known, the electronic circuits used in radiofrequency applications include oscillating circuits formed by the association of a capacitor and an inductor.

The trend toward the miniaturization of appliances such as, in particular, portable telephones requires such components to be produced with an increasingly small size.

Moreover, these inductive components are required to have optimum electrical properties at increasingly higher frequencies, and over increasingly wide frequency ranges.

Thus, with regard to the Q-factor which characterizes the inductors, one problem that arises is that of parasitic capacitances existing between the turns forming an inductive coil.

Furthermore, for reasons of autonomy and of electrical consumption, it is also important to limit the electrical resistance of these inductors, which resistance also has an influence on the value of the Q-factor.

Thus, the invention proposes to solve several problems, namely the influence of the resistance on the value of the Q-factor of an inductor as well as the limitation in the self-inductance coefficient, imposed by the existing geometries.

Moreover, in radiofrequency applications, signal or current microtransformers are also used which have to meet the same size constraints as those identified in the case of inductors.

Furthermore, the problem arises of obtaining as perfect magnetic coupling as possible between the two windings of a transformer.

It has already been proposed to produce microcomponents which include inductive coils produced by micromachining techniques. Such surface-mounted microcomponents are produced by winding a copper wire around a ferrite core or a core made of a ferromagnetic material, followed by joining to contact pads on the outside of bars.

Microtransformers have also been produced using the same techniques, with additional problems inherent in putting them into a plastic package. Such components are very difficult to miniaturize which means that the possibility of reducing their electrical consumption is limited and they remain large in size, limiting their uses in portable appliances.

Moreover, it has already been proposed, as illustrated in document U.S. Pat. No. 5,279,988, to fabricate microinductors or microtransformers by means of technologies of the type used in microelectronics.

Nevertheless, these techniques involve processes having a large number of steps, which makes them complex, and indeed expensive. Furthermore, the concatenation of this multitude of steps does not allow optimum coupling between the turns of the coil and the magnetic core to be obtained.

Moreover, the solutions involving micromechanical processes prove to be ineffective, since the necessary tolerances in these technologies greatly limit the precision of such microcomponents.

The object of the invention therefore is to solve the problems of the size of microinductors or microtransformers, while maintaining very good electrical properties either in terms of the value of the inductance or the Q-factor, or in terms of magnetic coupling.

Another problem that the invention aims to solve is that of the complexity of the processes for fabricating such microcomponents.

SUMMARY OF THE INVENTION

The invention therefore relates especially to a process for fabricating an electrical microcomponent, such as a microinductor or microtransformer, which includes at least one coil and comprises a substrate layer.

This process comprises the following steps, consisting:

- in etching a plurality of channels in the substrate, which channels are placed in an ordered manner as a band and are oriented so as to be approximately perpendicular to said band;
- in electrolytically depositing copper in said channels so as to form a plurality of segments;
- in planarizing the upper face of the substrate and of the plurality of segments;
- in depositing, on top of said substrate and of said segments, at least one layer intended to form a core;
- in etching the core in order for it to be preserved only above said band;
- in depositing a plurality of arches on top of the core in a single electrolysis step, each arch connecting one end of a segment with one end of an adjacent segment, passing above said core.

Thus, the substrate serves as a mechanical support, stiffening the base of the component. Furthermore, when the substrate used has good dielectric properties, the parasitic capacitance between the various segments forming the base of the microcomponent is relatively low.

Thus, according to the invention, these microcomponents comprise turns in three dimensions, of approximately helical shape approaching as close as possible the ideal shape, namely, for inductors, of circular cross section which, per turn produced, has the least perimeter.

In order to produce microtransformers, the top part of the turns is made in the manner of a bridge which straddles the core that will serve as magnetic circuit.

In order to produce inductors, an operation to remove said core is furthermore carried out after the step of depositing the arches, the sacrificial core then being made of a soluble resin or organic polymer material.

Consequently, a microinductor in the form of a solenoid is obtained which has no material interposed between the turns except for that part of the substrate into which the bottom of the turns is anchored. In this way, a microinductor with a high self inductance is obtained, the inter-turn parasitic capacitance of which is extremely low.

Such inductors therefore operate within wide frequency ranges with a high Q-factor.

The use of copper, preferably with a thickness of a few tens of micrometers, furthermore makes it possible to greatly reduce the resistance of the coil and to greatly increase the Q-factor, right from the low frequencies.

In one embodiment, the core is made of a ferromagnetic material. This ensures that there is magnetic coupling between the various turns of the coil. Thus, if a microinductor produced, the use of a magnetic core further increases the value of the self inductance.

Moreover, if the magnetic core has a loop geometry, it is thus possible to produce microtransformers by making a second coil similar to the first, by selecting the ratio of the number of turns between these two coils depending on the desired application.

In practice, in order to produce components which include a magnetic core, an insulating layer is deposited after the planarization step but before the layer intended to form the magnetic core is deposited. After the core has been etched, an insulating layer is deposited on top of the core. In this way, the segments forming the bottom of the turns and the arches forming the top of the turns are not in contact with the magnetic material.

Nevertheless, the small thickness of these insulating layers allows optimum coupling to be obtained since the segments and the arches of each turn are as close as possible to the magnetic core.

Furthermore, when the component is intended to be used in a wet, or indeed chemically aggressive, atmosphere, a passivation layer is deposited on top of the arches. In this way, risks of copper corrosion, which would degrade the electrical properties, and especially the electrical resistance of such a component, are overcome.

As already stated, the invention relates not only to the fabrication process but also to the electrical microcomponents, of the microinductor or microtransformer type, which include at least one inductive coil and comprise a substrate layer.

These microcomponents are distinguished in that said coil is formed from a plurality of adjacent turns placed in series as a band, each of the turns consisting:

- of a copper segment formed inside channels etched in the substrate;
- of an arch connecting one end of said segment to one end of the segment of the adjacent turn, passing above said band.

Consequently, the coil of such a microcomponent is in the form of a solenoid of great strength since it is firmly anchored into a substrate layer and, moreover, having optimum electrical properties because of the monolithic bridge or arch shape of the upper part of the turns.

Thus, according to various embodiments, the microcomponent may include a core made of ferromagnetic material, passing through the turns and placed between the segments and the arches.

If the core forms a closed loop, the microcomponent may also include a second coil wound around said core, so as to form the microtransformer.

In the case of an inductor, the magnetic core is in the form of a bar.

According to one characteristic of the invention, the space lying between the arches of the adjacent turns is filled with air, thereby very greatly limiting the value of the inter-turn parasitic capacitance and allowing the use of such a microinductor at high frequencies.

In a preferred form, at least the arches are covered with a passivation layer made of a material chosen from the group containing gold and gold-based alloys.

BRIEF DESCRIPTION OF THE DRAWINGS

The manner in which the invention is implemented and the advantages which stem therefrom will be clearly apparent from the description of the following embodiments, supported by the appended figures in which:

FIG. 7 is a top view of an inductor according to the invention;

FIG. 8 is a sectional view on the plane marked VIII—VIII in FIG. 7;

FIG. 9 is a sectional view on the plane marked IX—IX in FIG. 7;

DESCRIPTION OF THE PREFERRED EMBODIMENTS

As already stated, the invention relates to a process for producing an electrical microcomponent such as a microinductor or microtransformer, which may in particular include a magnetic core.

Many steps of the process are common to the production of microinductors and of microtransformers, so that in the rest of the description the common steps will be described only once.

The process for producing an inductor is illustrated in FIGS. 1 to 6.

Figure 1:
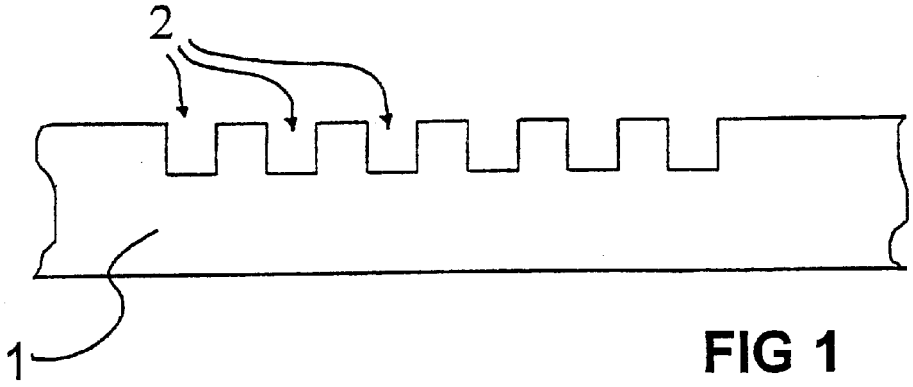
FIGS. 1 to 3, 5 and 6 are longitudinal sectional mid-views of an inductor produced according to the invention, as the sequence of steps of its fabrication process take place.

As illustrated in FIG. 1, one of the first steps of the process consist in producing a plurality of channels (2) in a substrate layer (1), preferably made of quartz.

By way of nonlimiting example, these various channels (2) have a depth of between 1 and 30 microns, a width of between 1 and 30 microns and a length of the order of 5 to several tens of microns. In one particular nonlimiting embodiment, each of these channels (2) is separated from one another by a distance of the order of a channel half-width.

These various channels (2) are placed in an ordered manner as a band (3), such as the band portrayed in FIG. 7 by dotted lines, which band corresponds to the general direction of the axis (4) of the coil of the microinductor or microtransformer.

In the embodiment illustrated, these channels (2) are perpendicular to the direction of the band (3), but other geometries may be adopted in which, for example, each channel has a fixed orientation with respect to the axis of the band.

Figure 2:
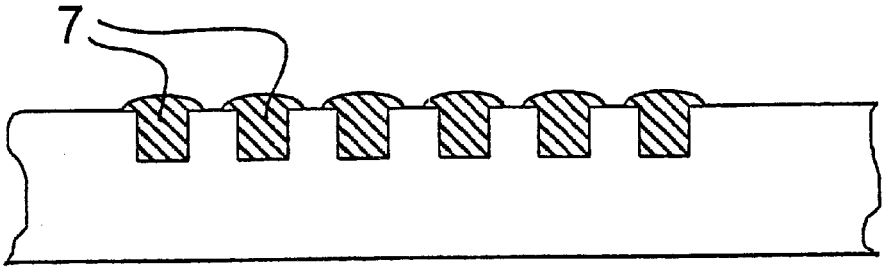

Next, as illustrated in FIG. 2, metal, advantageously copper, is electrolytically deposited inside the channels (2).

The use of copper, combined with the depth of the channels, makes it possible to obtain segments (7) having a relatively low electrical resistance, something which proves to be advantageous in terms of electrical consumption as well as for the Q-factor of an inductor.

Figure 3:
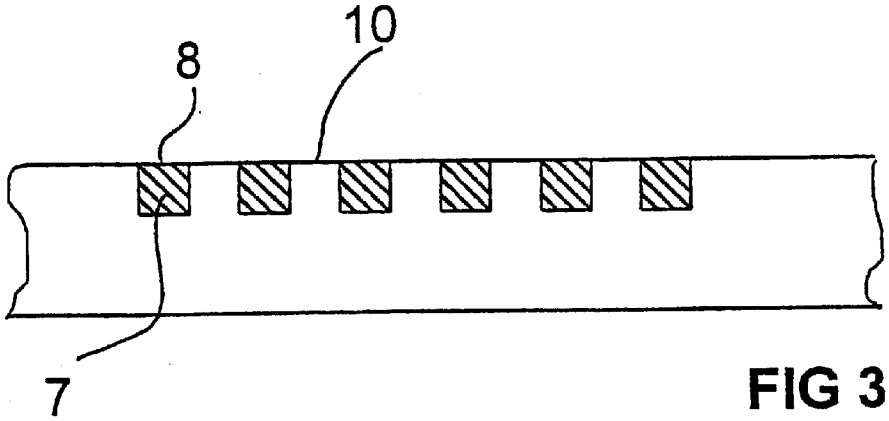

After the electrolytic deposition step, the planarization operation is carried out, as shown in FIG. 3, ensuring that as flat a surface finish as possible is obtained on the upper face of the substrate.

By this operation, the copper segments (7) present inside the channels (2) are also planarized and their upper face (8) is at the same level as the upper face (10) of the substrate (1).

In order words, the copper segments (7) are flush with the upper face (10) of the substrate (1).

Thereafter, the process differs depending on whether an air-core inductor or a microtransformer or an inductor with a magnetic core is produced.

Figure 4:
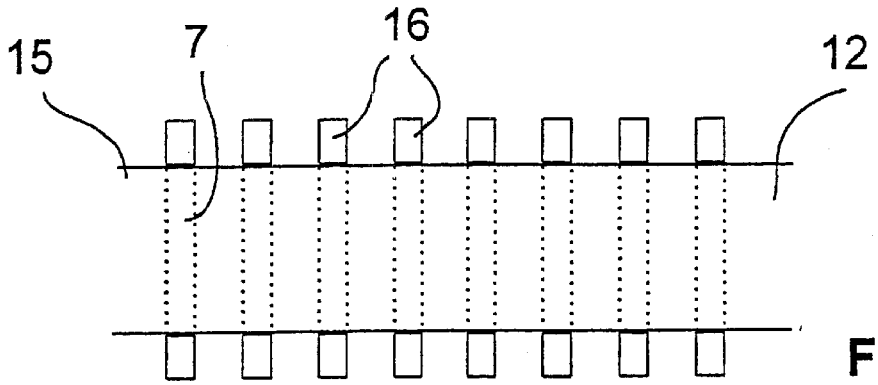
FIG. 4 is a top view of the same inductor after the step of etching the core.

Thus, if an air-core inductor is produced, a layer of polymer resin (12) intended to be removed at the end of the process, is deposited on top of the substrate (1) and of the copper segments (7). This polymer resin (12) is a photosensitive-type resin commonly used in this kind of microelectronics application. Thus, it is easy to define the bar-shaped geometry thereof and then, by creep, to end up with a semicircular-type shape without recourse to another process, as illustrated in FIG. 4.

Next, a metal growth sublayer (13) is deposited over the entire surface (10) of the substrate (1) and of the core or cores thus formed. A photosensitive resin (14) is then deposited on this metal growth sublayer (13).

Thereafter, the photosensitive resin (14) is exposed, using a mask allowing features (16) connecting two segments (7) anchored in the substrate to be opened.

Figure 5:
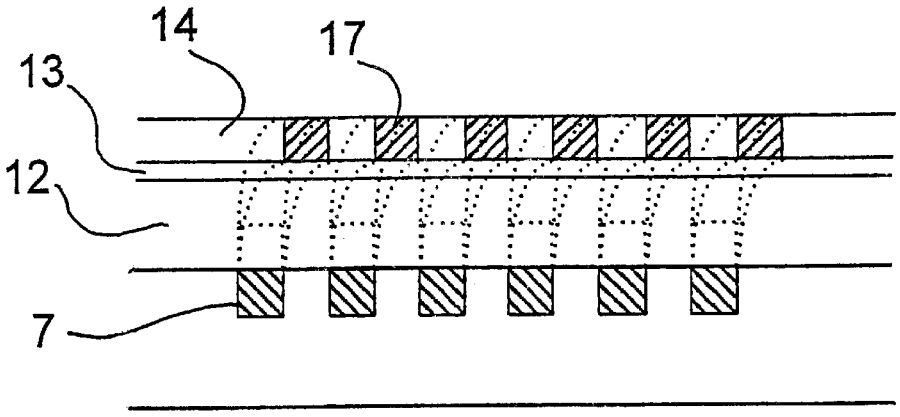

Thereafter, as illustrated in FIG. 5, the feature (16) thus opened is filled with electrolytically deposited metal so as to form a bridge (17) between two ends of adjacent segments (7). These bridges (17) are obtained in a single electrolysis step. The flanks of the features (16), made in the resin, make it possible to obtain arches (17) whose walls are relatively plane.

An etching step is then carried out which makes it possible to remove the resin (14) and the metal sublayer (13) which had served for the growth, in order to obtain a plurality of arches forming the top of the turns, resting on the core.

Figure 6:
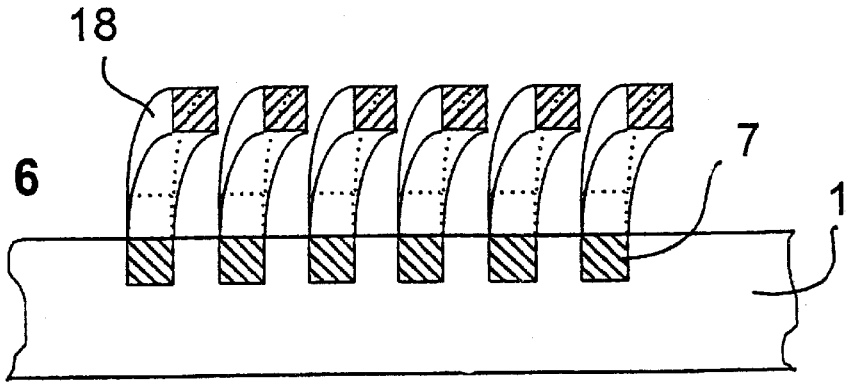

In order to obtain an air-core inductor, as illustrated in FIG. 6, the resin core (15), on which the metal arches (17) are formed, is removed by dissolution or plasma etching.

Thus, as illustrated in FIG. 7, an inductor is obtained which comprises straight segments (7) forming the bottom of each turn and monolithic arches (18) connecting adjacent segments (7).

As may be seen in FIG. 8, such turns thus have an approximately elliptical shape, approaching the ideal circular shape which has, per turn produced, the least perimeter.

Thereafter, a passivation layer, typically made of gold or gold-based alloy, is deposited in order to protect the copper from oxidation. This layer has a thickness of the order of a few hundred Angstroms.

In this way, the inductor thus obtained has turns which, for the most part, are separated from the following turns by an air layer, thereby very greatly limiting the inter-turn parasitic capacitance. The only parts of the turns not being separated by air are the straight segments (7), which are separated by a region of quartz substrate, the dielectric properties of which are also favorable in terms of parasitic capacitance.

As already stated, the invention also makes it possible to produce inductors incorporating a magnetic core, or microtransformers.

Thus, in order to produce such microcomponents, the process according to the invention involves the sequence of steps illustrated in FIGS. 1 to 3, namely the substrate-etching step, the copper-deposition step for forming the segments, and the planarization step.

Figure 10:
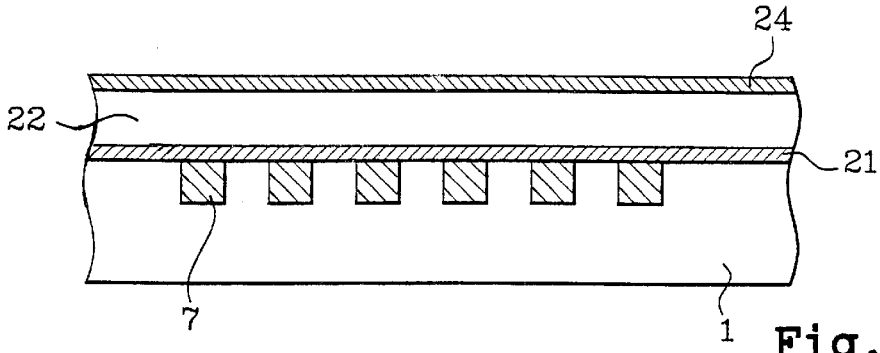
FIG. 10 is a longitudinal sectional midview of a transformer or of an inductor illustrated at the time the magnetic layer is being deposited.
Figure 11:
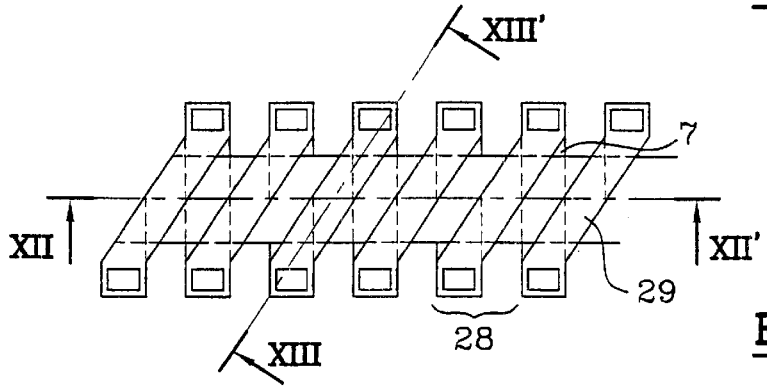
FIG. 11 is a top view of a winding of an inductor or of a transformer equipped with a magnetic core.

Thereafter, as illustrated in FIG. 10, an insulating layer (21) produced flat is deposited over the entire surface of the plate, that is to say on top of the substrate (1) and of the segments (7).

The thickness of this insulating layer (21) is minimized, typically of the order of a few tenths of microns, so as to limit the distance separating the magnetic core from the copper turns in order to improve the magnetic coupling.

Next, a layer of magnetic material (22) is deposited on top of the insulating layer (21), either by electrolysis or by reactive sputtering deposition.

Typically, the materials used for producing this magnetic layer are iron-nickel alloys generally called permalloy, or other laminated compounds.

Thereafter, the layer of magnetic material (22) is etched in order for the latter to be preserved only in the region corresponding to the location of the actual magnetic core. The magnetic material is etched, for example, using a photolithographic etching process known elsewhere.

Thereafter, when the magnetic material has the core configuration, a thin film of insulating material (24), with a typical thickness of the order of a few tenths of a micron, is deposited on top of the magnetic material.

The upper insulating film (24) extends over the magnetic core (22) and over the first insulating film (21) deposited on the substrate (2).

These two films (21, 24) are etched vertically in line with the ends of the segment (7) anchored in the substrate (2), so as to form a contact aperture allowing electrical connection between the segment (7) and the future arches which will be formed above the core.

As already described in the case of the production of air-core inductors, the process continues with the deposition of a metal growth sublayer on top of the magnetic core followed by the one-step formation of the copper arches intended to form the turns. The geometry of the ends of the arches makes it possible to maximize the area of contact with the bottom segment (7).

The process then concludes with the deposition of the gold- or gold-alloy-based passivation layer.

Figure 12:
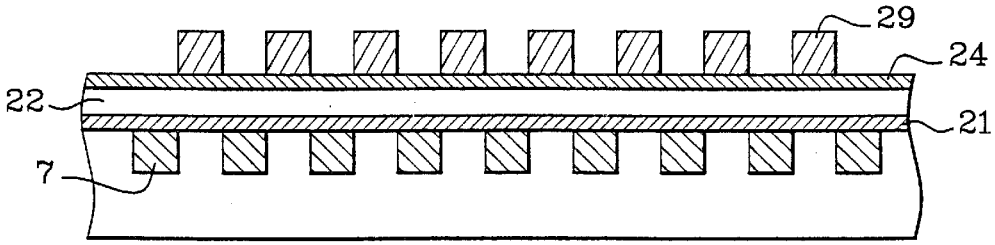
FIG. 12 is a sectional view on the plane marked XII—XII in FIG. 11.

In this way, the product partially illustrated in FIG. 12 is obtained, in which the turns (28) comprise straight segments (7) anchored in the substrate and arches (29) connecting the ends of two adjacent segments (7) placed on either side of the core (22).

Figure 13:
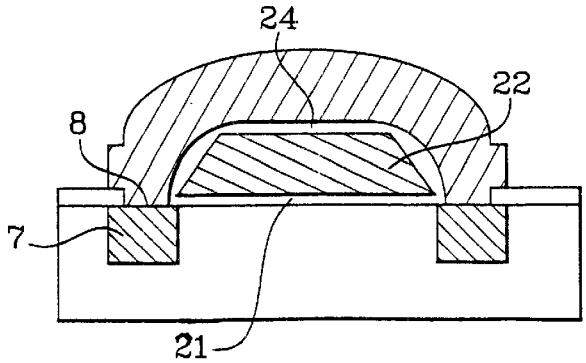
FIG. 13 is a sectional view on the plane marked XIII—XIII in FIG. 11.

As may be seen in FIGS. 12 and 13, the small thickness of the insulating films (21, 24) allow optimum magnetic coupling.

In this way, it is possible to produce inductors having a magnetic core intended to increase the self-inductance coefficient.

Thus, using this technique, it has been possible to obtain inductors within a range going from one nanohenry to a few tens of microhenries. Such inductors, in the version without magnetic core, may have a Q-factor of several tens at frequencies of a few gigahertz.

Figure 14:
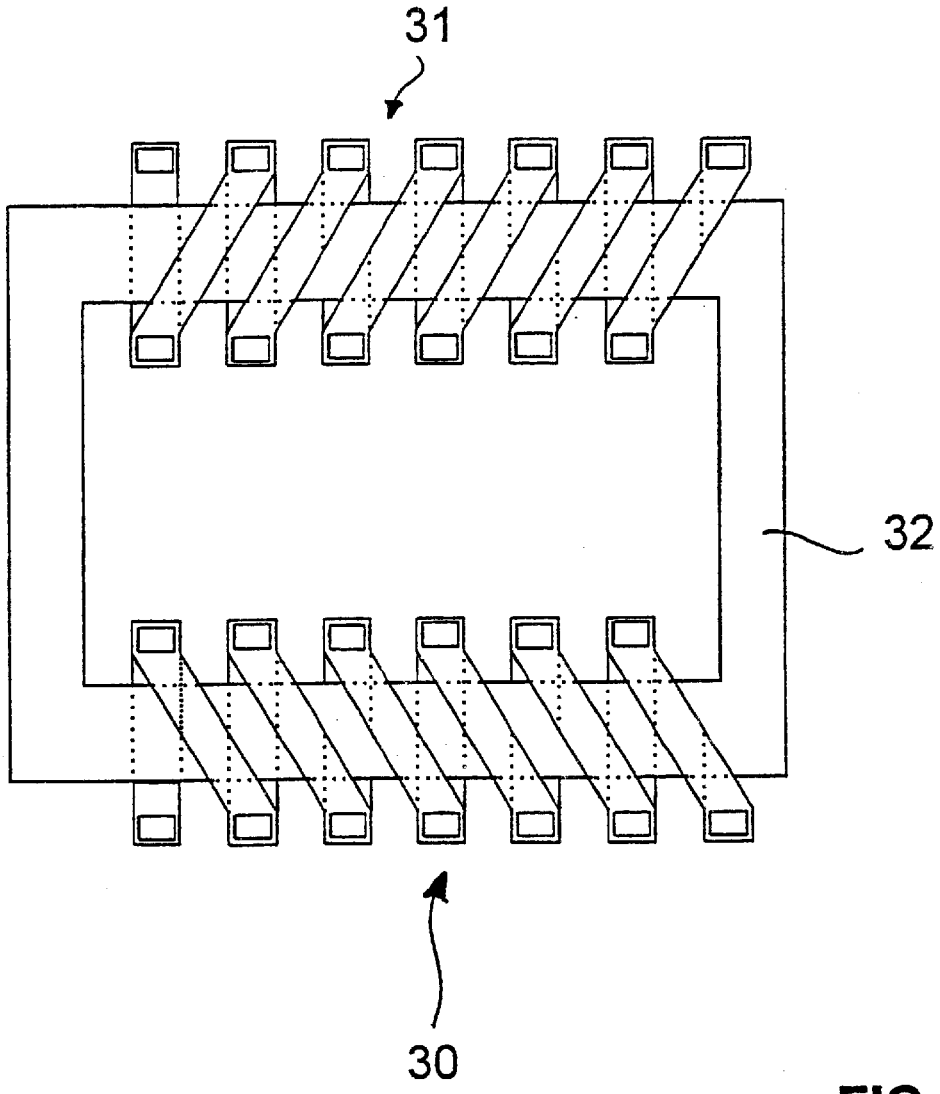
FIG. 14 is a schematic top view of a transformer produced according to the invention.

As already stated, the process according to the invention makes it possible to obtain, by the combination of two windings (30, 31) and of a closed-loop core (32), a microtransformer as illustrated in FIG. 14. Such transformers are used for galvanic isolation between circuit inputs and outputs, or else for signal-conversion applications.

INDUSTRIAL APPLICATIONS

The microcomponents produced according to the process of the invention can be used in many applications, and especially those connected with mobile telephony, with signal processing and with miniaturization.

Such components may especially be mounted using the known technique called "flip-chip" directly on integrated circuits.

What is claimed is:

1. A process for fabricating an electrical microcomponent that includes the steps of:

forming a plurality of parallel channels of equal length in a top surface of a non-conductive substrate so that the channel describes a rectangular band with the channel being generally perpendicular to the opposed side edges of the said band;

depositing a conductive metal in said channels to fill said channels and form a plurality of conductive segments;

smoothing the top surface of said substrate so that the top surface of the substrate is coplanar with the top surface of said segments;

depositing a core material upon the top surface of said substrate and the top surfaces of said segments to form a core;

etching the core material to preserve the core material over the band region;

electrolytically depositing a plural of conductive arches on top of said core material so that each connects one end of a segment with the opposite end of an adjacent segment to establish a coil encircling said core material.

2. The process of claim 1, wherein said core material is a resin and including the further step of removing the core after the coil is formed.

3. The process of claim 1, wherein said core is fabricated of a ferromagnetic material.

4. The process of claim 3 that includes the further step of depositing an insulating material upon the smoothed surfaces of the substrate and conductive segments prior to depositing said core material and further including the step of depositing an insulating material over the top of said core material.

5. The process of claim 1 that includes the further step of depositing a passivation material upon the top of said arches.

6. An electrical microcomponent that includes:

a non-conductive substrate having a series of parallel copper segments of equal length contained in a channel formed in a top surface of the substrate, wherein said channel describes a rectangular band;

conductive arches connecting one end of each segment with an opposite end of each segment with an opposite end of an adjacent segment to form a coil containing a series of turns.

7. The microcomponent of claim 6 that further includes a core of ferromagnetic material passing through the turns of said coil.

8. The microcomponents of claim 7, wherein said core is an endless loop and a second copper coil is wound about said loop to establish a micro-transformer.

9. The microcomponent of claim 7, wherein said core is an elongated bar.

10. The microcomponent of claim 6, wherein the space lying inside said coil is filled with air.

11. The microcomponent of claim 6 wherein the arches are covered with a passivation layer containing gold and gold-based alloys.

* * * * *